US005080327A

United States Patent [19]

Bai

[11] Patent Number: 5,080,327

[45] Date of Patent: Jan. 14, 1992

[54] AREA DISPLACEMENT DEVICE FOR MOLTEN METAL LADLE

[75] Inventor: Shen H. Bai, Toledo, Ohio

[73] Assignee: Doehler-Jarvis Limited Partnership, Toledo, Ohio

[21] Appl. No.: 583,463

[22] Filed: Sep. 17, 1990

[51] Int. Cl.[5] ..... B22D 41/04

[52] U.S. Cl. ..... 266/230; 266/275; 222/594

[58] Field of Search ..... 222/590, 594, 604, 629; 266/230, 227, 275

[56] References Cited

U.S. PATENT DOCUMENTS

| | | | |
|---|---|---|---|
| 1,160,275 | 11/1915 | Gibson . | |
| 1,188,248 | 6/1916 | Clarke . | |
| 1,200,684 | 10/1916 | Yarnall . | |
| 1,200,914 | 10/1916 | Bailey . | |
| 1,202,049 | 10/1916 | Gamble . | |
| 2,329,049 | 9/1943 | Hulme | 22/79 |
| 2,397,789 | 4/1946 | Hopkins | 22/61 |
| 2,828,516 | 4/1958 | Black et al. | 266/230 |
| 2,937,789 | 5/1960 | Tama | 222/590 |
| 3,160,929 | 12/1964 | Woodburn, Jr. | 22/68 |
| 4,112,998 | 10/1978 | Sato | 164/136 |
| 4,289,259 | 10/1981 | O'Brien | 222/590 |
| 4,299,268 | 11/1981 | Lavanchy et al. | 164/155 |
| 4,444,377 | 4/1984 | Groeteke et al. | 266/227 |
| 4,601,415 | 7/1986 | Koffron | 222/597 |
| 4,949,774 | 8/1990 | Keough et al. | 164/256 |

*Primary Examiner*—S. Kastler
*Attorney, Agent, or Firm*—Hugh Adam Kirk

[57] ABSTRACT

An open-top, heat-resistant container, such as a molten metal ladle for filling the shot sleeve of a die casting machine, having a block rigidly attached to the ladle and partly submerged into the surface of the molten metal in the container or ladle for reducing a major portion of at least half of the area of the exposed surface of the molten metal in the container. The block may be vertically adjustable for varying the amount of immersion into the molten metal when the predetermined amount of molten metal retained in the container has been reached by flow over a weir edge of the container or ladle. A fraction of a centimeter difference in level of molten metal in the container multiplied by the exposed area of molten metal in the container can amount to a kilogram difference in the molten metal measured by the tilt and weir of the container or ladle. Thus, the less the exposed area of the surface in the container, the more repeatable the measured amount of molten metal can be poured from the container. The ladle is mechanically movable from immersion in a tank of molten metal to a position above the tank for overflow of molten metal over the weir edge and/or tilting of the container to a predetermined angle to retain a measured amount of molten metal, and lastly pouring that measured amount into a mold, then starting the cycle over again.

10 Claims, 3 Drawing Sheets

AREA DISPLACEMENT DEVICE FOR MOLTEN METAL LADLE

BACKGROUND OF THE INVENTION

Mechanical means controlled automatically for immersing ladles into molten metal baths for filling the ladles, raising the ladle above the bath for excess liquid to run out over a weir edge thereof, the tilting of the ladle to a predetermined angle for preselecting a given volume of molten metal in the ladle, and then moving the ladle for pouring the measured amount of molten metal into a die or shot sleeve of a die casting machine are known in processes for the production of castings. Furthermore, filter means have been employed for reducing the amount of slag accumulation and dirt on the weir edge of the ladle, such as disclosed in the Groteke U.S. Pat. No. 4,444,337 issued Apr. 24, 1984, and covers for ladles for isolating slag are known as shown in the Masashi Kawana et al U.S. Pat. No. 3,759,701 issued Sept. 18, 1973. Also the Groteke patent discloses the use of a movable displacement device for urging the molten metal from the ladle into the mold.

It is also known that floats have been employed in open top containers for gauging the flow of the contents thereof over weirs, but such floats are not rigidly attached to the container, nor would they perform their function if they were.

Thus there is no known prior art in which the repeatability and accuracy of measuring molten metal in a ladle has been obtained in production operations as is possible by applicant's invention.

SUMMARY OF THE INVENTION

Generally speaking, this invention involves an improved ladle which is mechanically immersed in molten metal bath for the quick filling thereof, the draining of the molten metal from the ladle by flow over the edge of the ladle, the tipping of the ladle to a predetermined angle for measuring a predetermined volume of molten metal retained in the ladle by pouring over a weir edge of the ladle, and then moving the ladle quickly to the mold for pouring the measured amount or emptying the ladle into the mold or shot sleeve of a die casting machine.

The invention comprises rigidly suspending and partially immersing a block of refractory material into the surface of the molten metal in a ladle, particularly during the step of measuring the volume of the molten metal in the ladle so as to reduce the exposed surface area of molten metal in the ladle. Since a fraction of a centimeter of wear or dirt build-up on the weir edge of the ladle can cause a material variation in the amount of liquid metal that flows over that weir edge determined by the exposed surface area of the molten metal in the ladle, the reduction of this area by at least half increases the accuracy and repeatability of the measured volume of molten metal in the container by a factor of at least 2. Thus, the greater the area of molten metal in the container which is displaced by the block, the less the variation in the volume due to variations in the depth of molten metal determined by the variations in the weir edge. However, the surface area of the open top container or ladle should not be so completely covered that the ladle cannot be filled quickly by immersion into the vat of molten metal. This area displacement block is rigidly attached to the ladle either by a bridge over the top thereof or to a bracket to which the ladle is supported. Preferably the block is adjustably connected to the ladle such as by a bolt and lock nuts for varying the relatively vertical position or amount of immersion of the block in the measured amount of molten metal.

For example, a variation of a millimeter in the height or depth of the weir edge of the ladle multiplied by the square centimeter surface area of the ladle can amount to a kilogram in weight or a liter in volume of molten metal measured, if the ladle has a relatively large surface area. Thus by reducing this surface area and adjusting the angle of tilt to compensate for the displacement of the block partially immersed in the molten metal increases the accuracy and repeatability of volume or weight of molten metal dispersed from the ladle.

OBJECTS AND ADVANTAGES

Accordingly, it is an object of this invention to increase the efficiency, effectiveness, repeatability, and accuracy of the volume of molten metal measured in a ladle for injecting into a mold.

Another object is to decrease the effect of the dirt, or slag, or wear on the weir edge of a molten metal ladle which is tilted to a predetermined angle for obtaining a repeatable measured volume of molten metal in a container by pouring excess molten metal over said weir edge.

Further objects are to reduce the variations in metered molten metal from a ladle and thereby reduce the variations in thickness of the biscuit at the end of a shot sleeve in a die casting machine, and/or reduce the variations in size of risers used in molds.

A further object of the displacement device of this invention is to decrease the heat loss from the molten metal in the ladle due to this device's heat insulation properties and its decrease in the area of open molten metal in the ladle.

BRIEF DESCRIPTION OF THE VIEWS

The above mentioned and other features, objects and advantages and a manner of attaining them are described more specifically below by reference to embodiments of this invention shown in the accompanying drawings, wherein.

Figure 5:
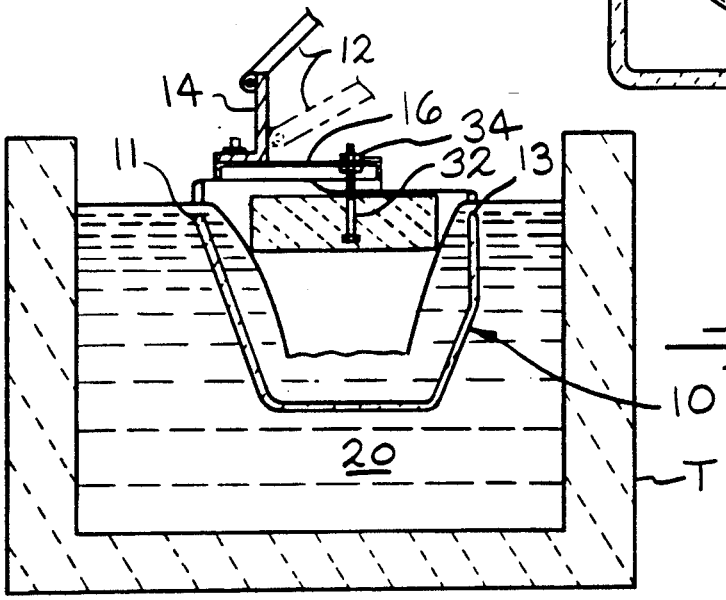
FIG. 5 is a reduced vertical sectional view of the ladle shown in FIG. 3 being immersed into a molten metal bath for the filling of the ladle with molten metal.
Figure 6:
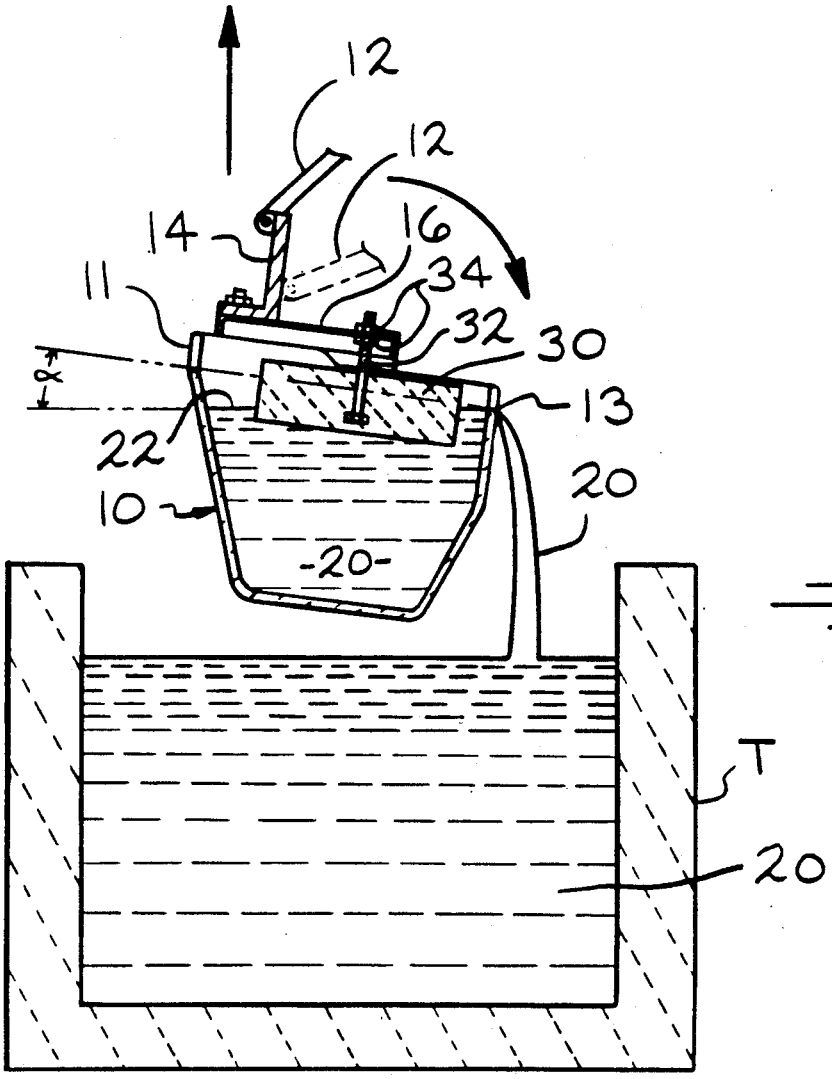
Figure 7:
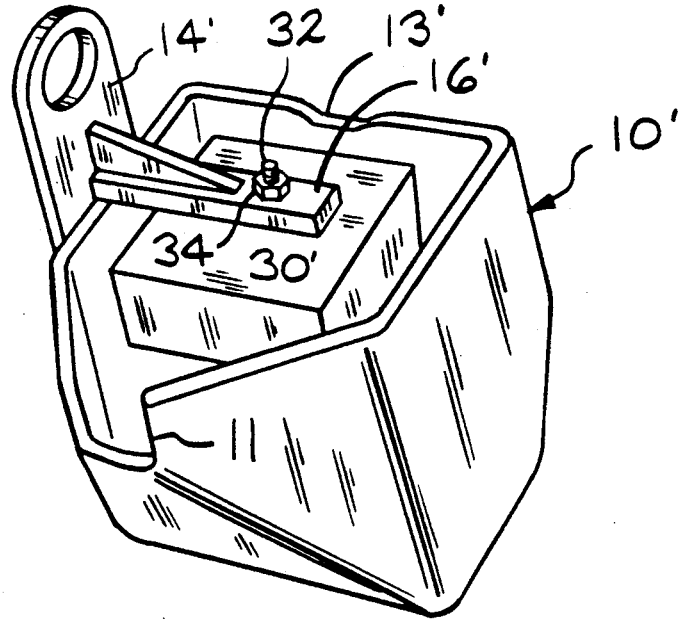

FIG. 6 shows the filled ladle from FIG. 5 raised above the bath and tilted to a predetermined angle for overflow of excess molten metal back into the bath to determine a predetermined volume of metal in the ladle and the showing of the area displacement block of this invention suspended into the surface of the molten metal reducing the exposed surface area of the molten metal in the ladle; and FIG. 7 is a perspective view of another embodiment of this invention showing a different suspension means and shape of displacement block for in a ladle in a pouring position.

DETAILED DESCRIPTION OF PREFERRED EMBODIMENTS

Figure 1:
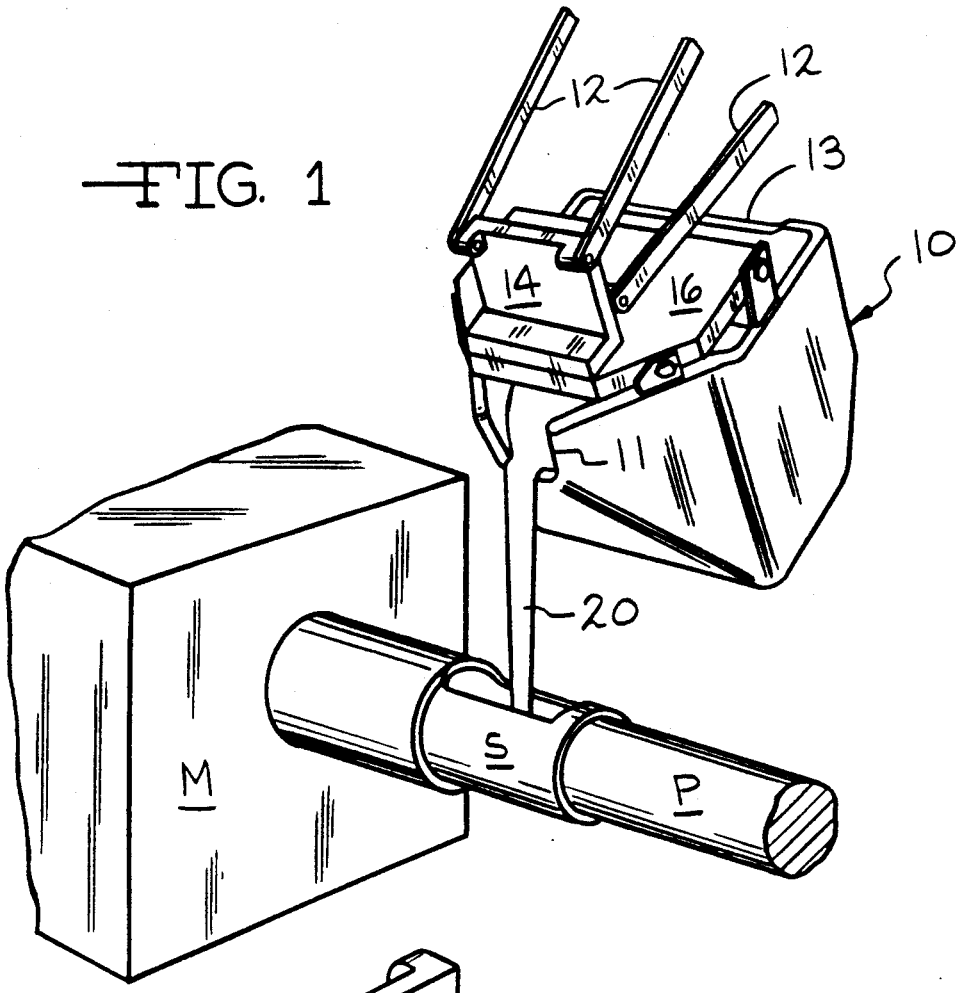
FIG. 1 is a perspective view of a ladle pouring molten metal into a shot sleeve of a die casting machine.
Figure 2:
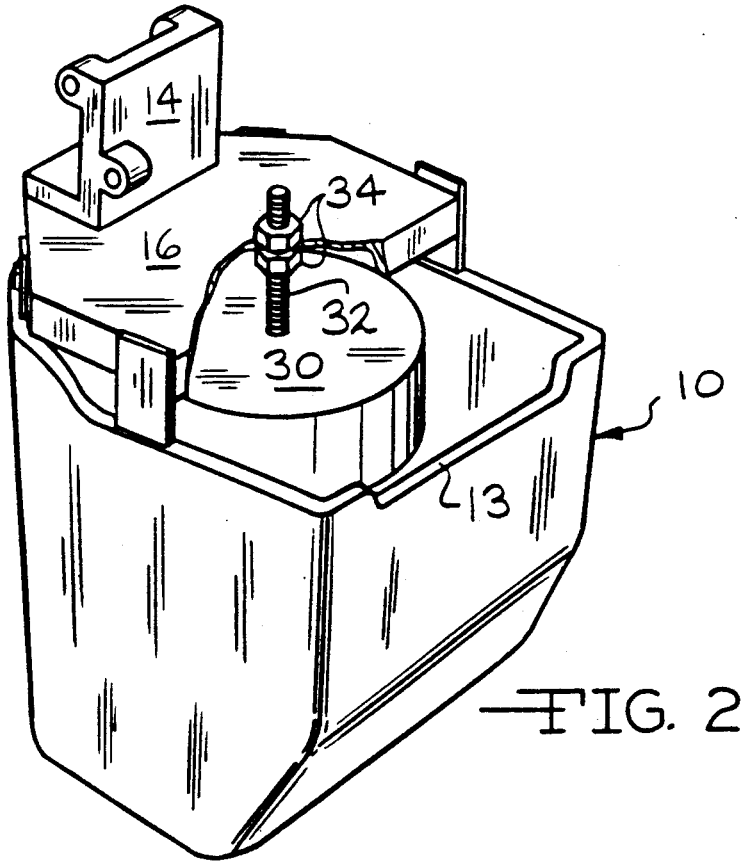
FIG. 2 is an enlarged perspective view at another angle of the ladle shown in FIG. 1 with parts broken away to show a preferred embodiment of the block for suspending into the surface of the molten metal according to a preferred embodiment of this invention.

Referring first to FIG. 1, there is shown a ladle 10 which is supported and tilted by levers 12 connected to a bracket 14 attached to the ladle 10 by means of a bridging plate 16 rigidly connected to the upper edge of the ladle 10. This ladle 10 in FIG. 1 is shown pouring molten metal 20 into the shot sleeve S in front of its piston P of a die casting machine M.

As shown in FIGS. 2 through 6 fixedly suspended from the bridging plate 16 is a surface area and volume displacement block 30 of this invention. This block 30 is shown to be adjustably suspended from the plate 16 by means of threaded bolt 32 having lock-engaging nuts 34 on opposite sides of the plate 16. This rigid adjustable means 32, 34 enables control of the immersion of the block 30 into the molten metal 20 when the ladle is in its volume measuring position as more clearly shown in FIG. 6.

Although the open-top container or ladle 10 is shown in FIGS. 1 through 7 to have a spout 11 on one side thereof and a weir edge 13 on the opposite side from the spout 11, the weir edge may comprise a narrower edge 13' as shown in FIG. 7, or the regular unnotched edge of the ladle without departing from the scope of this invention.

In the embodiment shown in FIG. 7 there is only shown a side bracket 14' for suspending the ladle 10', which side bracket 14' has an arm 16' which extends partially over the open top of the ladle 10' for fastening the bolt means 32, 34 for adjustably suspending the block 30'. This block 30' is shown to have a different configuration, namely rectangular, as distinguished from the cylindrical block 30 shown in the other views. Nevertheless, it is to be understood that this area displacement block may have other thicknesses and/or shapes than that shown, depending upon the size and shape of the open top of the ladle to which it is to be adapted.

Figure 3:
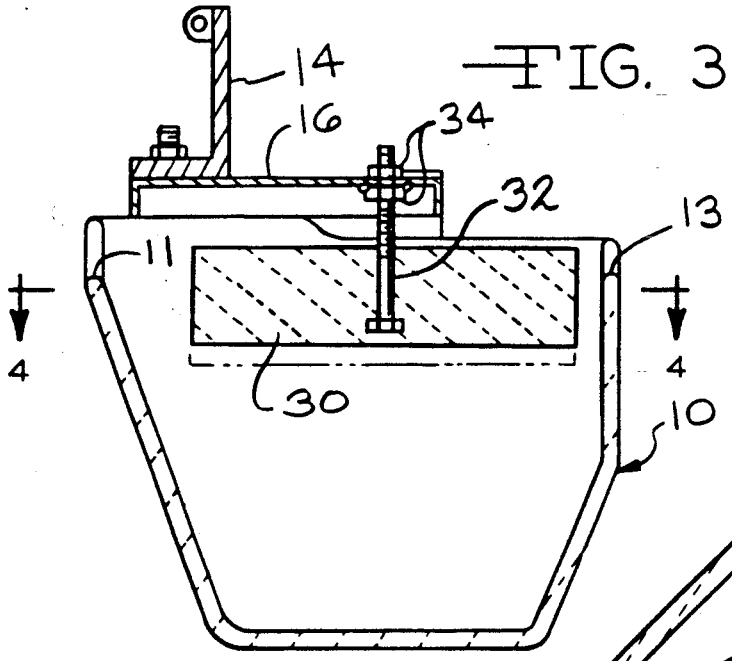
FIG. 3 is a vertical sectional view through the ladle and suspended block shown in FIG. 2.
Figure 4:
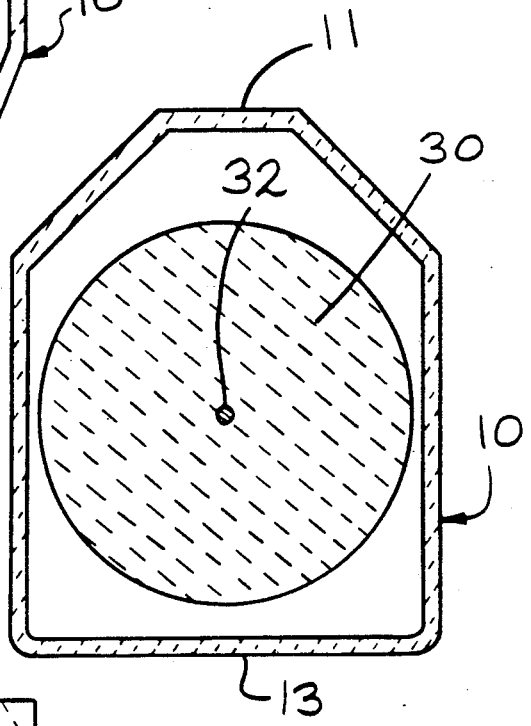
FIG. 4 is a sectional view taken along line 4—4 of FIG. 3 showing the major portion of the surface area of a liquid in the ladle being displaced by the block of this invention.

In FIGS. 3 and 4, the block 30 of this invention covers and is suspended in a major portion of the open top of the ladle 10 and/or liquid surface 22 shown in FIG. 6. Thus the exposed area of molten metal in the surface of the ladle is less than half of the total area of the open top of the ladle.

Referring now to FIGS. 5 and 6, the ladle 10 is filled by immersion into a molten metal bath or tank T which is filled with molten metal 20 and as shown in FIG. 5 the ladle 10 is immersed into the molten metal 20 in tank T, so that the molten metal flows freely and quickly over the weir edge 13 and spout 11 for quickly filling the container or ladle to more than the volume required for the mold. The ladle is then raised vertically out of the tank as shown in FIG. 6 and tilted to a predetermined angle alpha ($\alpha$) for pouring out the excess molten metal 20 so as to retain as accurately as possible a predetermined measured amount of molten metal needed for the mold. The ladle is then levelled and moved to the mold or shot sleeve of a die casting machine as shown in FIG. 1 where all the measured contents left in the ladle 10 are poured into the mold or shot sleeve S.

Once the angle alpha as shown in FIG. 6 is determined and programmed into the mechanical mechanism for moving the ladle 10, any wear or build-up of dirt on the weir edge 13 would change the level 22 of the molten metal 20 in the ladle 10 shown in FIG. 6. Thus a millimeter change in level 22 multiplied by the exposed surface area around the outside of the block 30 would be a considerable less change in volume than would occur if the block 30 were not employed and immersed into the surface of the molten metal 22. Accordingly, the larger the block 30 with respect to the open top of the ladle 10, the more reliable and accurate will be the volume of liquid that will be measured in the ladle 10 in the measuring position shown in FIG. 6 and then poured into a mold.

It is important that the ladle 10 and also the blocks 30 and 30' be made of heat resistant material such as refractories or metal that will withstand the temperature of the molten metals that they are to contain. Furthermore, the type of brackets employed for supporting and tilting the ladle may vary providing the different positions explained and described can be attained. Although FIG. 1 shows the ladle used for measuring the liquid for a shot sleeve of a die casting machine, the measured liquid is also important for any precision-type casting, whether under pressure or gravity. Furthermore, the shape and size of the ladle also may vary as well as the position and shape of the weir edge and spout, and even includes containers without such specific edge configurations.

While there is described above the principles of this invention in connection with specific apparatus, it is to be clearly understood that this description is made only by way of example and not as a limitation to the scope of this invention.

I claim:

1. In a molten metal ladle comprising:

a) an open-top container having a top weir gauging edge, and b) means for moving said container for filling said container with molten metal, for measuring the volume of molten metal by flow over said weir gauging edge, and for pouring said measured volume of molten metal from said container;

the improvement comprising:

c) a block means rigidly attached to said container and suspended into a portion comprising at least half of the area of the surface of the molten metal in said container when said container is in its volume-measuring position, whereby said block means reduces the exposed surface of molten metal in said container to reduce changes in volume of molten metal in said container due to variations in gauging level of said weir due to deposits of impurities on and wear of said weir.

2. A ladle according to claim 1 wherein said ladle and block are composed of heat-resistant material.

3. A ladle according to claim 1 wherein said top edge includes a spout.

4. A ladle according to claim 1 wherein said moving means includes means for tilting said container around a horizontal axis.

5. A ladle according to claim 4 wherein said tilting means tilts said container in one direction for filling the container with molten metal and in the other direction for pouring molten metal from said spout.

6. A ladle according to claim 1 wherein said moving means tilts said container to a predetermined angle for measuring the volume of molten metal in said container.

7. A ladle according to claim 1 wherein said moving means immerses said container into a bath of molten metal for filling said container.

8. A ladle according to claim 1 wherein said block is vertically adjustable relative to its attachment to said container.

9. A ladle according to claim 1 including a bridge across the open top of said container for attaching said block means.

10. A ladle according to claim 1 wherein said weir comprises a notch in the top edge of said container.

* * * * *